United States Patent [19]

Marchesano

[11] Patent Number: 4,987,060

[45] Date of Patent: Jan. 22, 1991

[54] CONCENTRATED PHOTOGRAPHIC DEVELOPER COMPOSITION AND METHOD OF MAKING IT

[75] Inventor: Carlo Marchesano, Savona, Italy

[73] Assignee: Minnesota Mining and Manufacturing Company, St. Paul, Minn.

[21] Appl. No.: 498,208

[22] Filed: Mar. 23, 1990

[30] Foreign Application Priority Data

Apr. 3, 1989 [IT] Italy ..... 19993 A/89

[51] Int. Cl.[5] ..... G03C 5/30; G03C 5/24

[52] U.S. Cl. ..... 430/434; 430/438; 430/450; 430/458; 430/464; 430/465; 430/466; 430/490; 430/491; 430/493

[58] Field of Search ..... 430/434, 438, 450, 458, 430/490, 491, 493, 465, 466, 464; 252/397, 400.61, 406

[56] References Cited

U.S. PATENT DOCUMENTS

| | | | |
|---|---|---|---|
| 2,891,861 | 6/1959 | Welliver | 430/465 |
| 2,893,865 | 7/1959 | Welliver et al. | 430/465 |
| 3,467,521 | 9/1969 | Frank et al. | 96/66.1 |
| 3,549,370 | 12/1970 | Sykes et al. | 430/458 |
| 3,589,902 | 6/1971 | Himmelmann et al. | 96/66 |
| 3,733,199 | 5/1973 | Crough et al. | 430/458 |
| 4,619,886 | 10/1986 | Okutsa | 430/458 |

FOREIGN PATENT DOCUMENTS

| | | | |
|---|---|---|---|
| 680394 | 11/1966 | Belgium | 430/466 |
| 664481 | 6/1963 | Canada | 430/466 |
| 998551 | 10/1976 | Canada . | |
| 0136582A2 | 4/1985 | European Pat. Off. . | |
| 02934 | 10/1981 | PCT Int'l Appl. | 430/466 |
| 931007 | 7/1963 | United Kingdom . | |
| 1184017 | 3/1970 | United Kingdom | 430/466 |

*Primary Examiner*—Paul R. Michl
*Assistant Examiner*—Patrick A. Doody
*Attorney, Agent, or Firm*—Donald M. Sell; Walter N. Kirn; Mark A. Litman

[57] ABSTRACT

A concentrated alkaline photographic developer composition, packaged in a single part to be diluted with water to form a ready to use developing solution for silver halide photographic materials, which comprises dihydroxybenzene developing agents, inorganic alkali agnets, inorganic antioxidant agents, sequestering agents and antifoggants, wherein said inorganic antioxidant agents comprise $Na_2SO_3$ (sodium sulfite) and $K_2SO_3$ (potassium sulfite) in a molecular ratio of 1:1 to 1:3 in an amount of from 1.6 to 4 moles per liter, the molecular ratio between said inorganic antioxidant agents and the developing agents is from 1.50 and 4.00, and said concentrated developer composition has a specific gravity higher than 1.300 at 20° C., and a method of making a concentrated alkaline photographic developer composition, packaged in a single part to be diluted with water to form a ready to use developing solution for silver halide photographic materials, which comprises dihydroxybenzene developing agents, inorganic alkali agents, inorganic antioxidant agents, sequestering agents and antifoggants, characterized in that comprises the following steps:

(a) preparing an aqueous KOH concentrated solution having a specific gravity not higher than 1.110 at 20° C., (b) adding to the resulting solution inorganic antioxidant agents which form sulfite anions ($SO_3^{--}$) in aqueous solution, at least half in moles of which being $NA_2S_2O_5$ (sodium metabisulfite), in a quantity of from 0.8 to 2 moles per liter, (c) adding to the resulting solution further aqueous KOH concentrated solution until the specific gravity of the resulting solution is $\geqq 1.175$ at 20° C., (d) adding to the resulting solution developing agents in such a quantity that the molecular ratio between said inorganic antioxidant agents and the developing agents is from 1.5 to 4.00, and (e) adding the other components of the developer composition in such a quantity to obtain a concentrated developer composition having a specific gravity higher than 1.300 at 20° C.

9 Claims, No Drawings

CONCENTRATED PHOTOGRAPHIC DEVELOPER COMPOSITION AND METHOD OF MAKING IT

FIELD OF THE INVENTION

This invention relates to a concentrated alkaline photographic developer composition to be diluted with water to form a ready to use developer solution for silver halide photographic materials, and to a method of making said concentrated photographic developer composition.

BACKGROUND OF THE ART

In general, the processing of black and white silver halide photographic materials is carried out in the order of development, stopping, fixing and washing.

The development of said photographic materials is typically carried out with aqueous alkaline developing solutions comprising one or more developing agents. These solutions are conventionally relatively dilute, therefore it is not generally feasible, from an economic standpoint, to package, transport and store developing solutions of working strength since this would involve the packaging, transporting and storage of large amounts of water. Heretofore, there have been four distinctly different approaches taken to the problem of packaging photographic developing compositions in a form that is suitable for transporting and storage. The first approach involves the preparation of dry powder mixtures which must be dissolved in water and then diluted to the proper volume before use. The second approach involves the formulation of photographic developing compositions in tablet form. The third approach involves the preparation of photographic developing concentrates as paste-like compositions. The fourth approach involves the preparation of liquid concentrates, that is concentrated solutions which merely have to be diluted with water to obtain a working strength (ready to use) solution.

Examples of such packaged developing formulations are described in numerous patents and publications, such as the dry powder developer mixtures in U.S. Pat. Nos. 2,843,484 and 2,846,308, the tablet form in CA patent No. 831,928, the paste-like compositions in U.S. Pat. Nos. 2,735,774, 2,784,086 and in IT patent No. 427,967, the developer concentrates in U.S. Pat. No. 3,178,284, 3,467,521, 3,532,498, 3,589,902, 3,854,948 and 4,046,571, in GB patent No. 1,372,755 and in CA patent No. 998,551.

Each of the prior art approaches possesses both advantages and disadvantages. For example, the use of dry powder mixtures avoids the expense involved in shipping and storing of water and enables the preparation of compact light-weight packages that require little storage space. However, dry powder mixtures are highly disadvantageous in that they are difficult to handle, create a hazard as a result of the generation of dust, require highly accurate weighing and dispensing techniques which are difficult to control, and often require difficult and time-consuming procedures as to bring about dissolution in water during preparation of the working strength solution.

On the other hand, the formulation of photographic developing compositions in tablet form has many advantages but is not, in general, a feasible commercial alternative to the use or other techniques, because the preparation of tablets is a very complex and expensive procedure, and many photographic developing compositions are not suitable to tablet formation. Moreover, tablets usually require the use of large amounts of binding agents, and these binding agents can make the dissolution of the tablets difficult and/or cause adverse sensitometric effects in processing. One approach to the problem of promoting prompt dissolution of the photographic processing tablets is to incorporate effervescing agents. However, the use of these materials is generally not very effective and introduces additional costs and complexity in the manufacturing operation.

The use of developing concentrates of paste-like consistency suffers from such problems as poor flow characteristics which render them very difficult to handle, lack of chemical stability, a tendency to separate, cake or crystallize, and poor solubility characteristics, so that they have been difficult to dissolve. The use of suspending, binding, thickening or gelling agents adds substantially to the cost and complexity of the manufacturing operation and can create problems of microbilogical growth formation and the formation of scums and residues in processing operations. Moreover, there are very few, if any, such agents that will function effectively under conditions of high pH and/or high salt concentration. In some instances, paste-like developing concentrates have been prepared without the use of suspending, binding, thickening or gelling agents, but these compositions have exhibited similar disadvantageous dissolving characteristicas.

At last, liquid concentrates are very convenient to use and much less hazardous, since they eliminate the dust problem, they can be very readily diluted to working strength solution without the need for laborious mixing operations and they do not need particular additive agents. In spite of this, there is a severe problem involved with such liquid concentrates of photographic developing compositions as there is a tendency for chemical interactions or modifications to take place between certain of the components in a single liquid concentrate. This frequently prevents combining all of the components in a single liquid concentrate, and necessitates the separation of the components into two or more parts which must be subsequently combined to form the final processing solution. This greatly complicates the packaging operation and adds to the expense of manufacture, transport and storage. A solution for this problem is disclosed in U.S. Pat. No. 3,178,284 or in EP patent application Ser. No. 136,582, but a limit for the maximum concentration is involved with the solubility of the components within the condition of storage and use. In particular this problem involves the quantity of developing agents (such as dihydroxybenzene developing agents, e.g. hydroquinone) and of inorganic antioxidant agents (such as alkali metal sulfites and metabisulfites) as disclosed in U.S. Pat. No. 3,589,902 column 1 lines 45–64, U.S. Pat. No. 3,467,521 column 1 lines 25–31, GB patent No. 1,372,755 page 1 lines 9–14 and CA patent No. 998,551 page 1 lines 9–16, here incorporated for reference. Additionally, in the use of alkali metal sulfites and metabisulfites, the cheaper sodium salts are poorly soluble in the highly concentrated alkaline developer solutions (less than 7% by weight), so that it is necessary to use the more soluble (about 25% by weight) but expensive potassium salts.

SUMMARY OF THE INVENTION

A method has been now found for making a highly concentrated alkaline photographic developer composition, packaged in a single part to be diluted with water to make a ready to use developing solution for silver halide photographic materials, that overcomes the problems of prior art concentrated developer compositions.

Briefly, the method comprises the following steps:

(a) preparing an aqueous KOH concentrated solution having a specific gravity not higher than 1.110 at 20° C., (b) adding to the resulting solution inorganic antioxidant agents which form sulfite anions ($SO_3^{--}$) in aqueous solution, at least half in moles of which being $Na_2S_2O_5$ (sodium metabisulfite), in a quantity of from 0.8 to 2 moles per liter, (c) adding to the resulting solution further aqueous KOH concentrated solution until the specific gravity of the resulting solution is $\geqq 1.175$ at 20° C., (d) adding to the resulting solution developing agents in such a quantity that the molecular ratio between said inorganic antioxidant agents and the developing agents is from 1.5 to 4.00, and (e) adding the other components of the developer composition in such a quantity to obtain a concentrated developer composition having a specific gravity higher than 1.300 at 20° C.

The developing agents for use in the method of the present invention are preferably dihydroxyoenzene developing agents, such as hydroquinone and substituted hydroquinones, and are incorporated in the concentrated developer composition preferably in the presence of an organic solvent, more preferably in the presence of an alkanolamine.

According to this invention, it is provided a highly concentrated alkaline photographic developer composition in a single part using the cheaper sodium salts and having improved aerial oxidation resistance.

DETAILED DESCRIPTION OF THE INVENTION

Accordingly, in one aspect the present invention relates to a method of making a highly concentrated alkaline photographic developer composition, packaged in a single part to be diluted with water to form a ready to use developing solution for silver halide photographic materials, which comprises dihydroxybenzene developing agents, inorganic alkali agents, inorganic antioxidant agents, sequestering agents and antifoggants, characterized in that comprises the following steps:

(a) preparing an aqueous KOH concentrated solution having a specific gravity not higher than 1.110 at 20° C., (b) adding to the resulting solution inorganic antioxidant agents which form sulfite anions ($SO_3^{--}$)in aqueous solution, at least half in moles of which being $Na_2S_2O_5$ (sodium metabisulfite), in a quantity of from 0.8 to 2 moles per liter, (c) adding to the resulting solution further aqueous KOH concentrated solution until the specific gravity of the resulting solution is $\geqq 1.175$ at 20° C., (d) adding to the resulting solution developing agents in such a quantity that the molecular ratio between said inorganic antioxidant agents and the developing agents is from 1.5 to 4.00, and (e) adding the other components of the developer composition in such a quantity to obtain a concentrated developer composition having a specific gravity higher than 1.300 at 20° C.

The inorganic antioxidant agents useful in the present invention are the alkali metal salts capable of forming, after dissolution in water or in alkaline water solutions, sulfite anions ($SO_3^{--}$). The preferred inorganic antioxidant agent is $Na_2S_2O_5$ (sodium metabisulfite), alone or in combination with $K_2S_2O_5$ (potassium metabisulfite). In particular, it has unexpectedly found that, following the conditions of the method of this invention, it is possible to avoid the following chemical reaction between KOH and $Na_2S_2O_5$ which forms water insoluble $NaKSO_3$ (sodium potassium sulfite):

$$Na_2S_2O_5+2KOH \rightarrow 2NaKSO_3+H_2O$$

because this reaction takes place when the specific gravity at 20° C. of the aqueous KOH solution is higher than 1.175. In particular when the specific gravity at 20° C. of the KOH solution is equal to or lower than 1.110, only the following reaction takes place which forms water soluble sodium sulfite and potassium sulfite:

$$Na_2S_2O_5+2KOH \rightarrow Na_2SO_3+K_2SO_3+H_2O$$

As soon as the $Na_2S_2O_5$ powder has been dissolved in the alkaline water with specific gravity equal or lower than 1.110, it is possible to add the remaining part of KOH (needed to obtain the working pH range, higher than 11, for developing the photographic material) without any precipitation problems.

In order to avoid the crystallization phenomena, typical of $Na_2S_2O_5$ at low temperature storage, it is preferable to use, in the method of making the concentrated developer composition according to this invention, both $Na_2S_2O_5$ and $K_2S_2O_5$ in a molecular ratio of 1:1.

Accordingly, in a preferred aspect the present invention relates to a method of making a highly concentrated alkaline photographic developer composition, packaged in a single part to be diluted with water to form a ready to use developing solution for silver halide photographic materials, which comprises dihydroxybenzene developing agents, inorganic alkali agents, inorganic antioxidant agents, sequestering agents and antifoggants, characterized in that comprises the following steps:

(a) preparing an aqueous KOH concentrated solution having a specific gravity not higher than 1.110 at 20° C., (b) adding to the resulting solution inorganic antioxidant agents which form sulfite anions ($SO_3^{--}$) in aqueous solutions, comprising $Na_2S_2O_5$ (sodium metabisulfite) and $K_2S_2O_5$ (potassium metabisulfite) in a molecular ratio of about 1:1, in a quantity of from 0.8 to 2 moles per liter, (c) adding to the resulting solution further aqueous KOH concentrated solution until the specific gravity of the resulting solution is $\geqq 1.175$ at 20° C., (d) adding to the resulting solution developing agents in such a quantity that the molecular ratio between said inorganic antioxidant agents and the developing agents is from 1.50 and 4.00, and (e) adding the other components of the developer composition in such a quantity to obtain a concentrated developer composition having a specific gravity higher than 1.300 at 20° C.

In another aspect the present invention relates to a concentrated alkaline photographic developer composition, packaged in a single part to be diluted with water to form a ready to use developing solution for silver halide photographic materials, which comprises dihydroxybenzene developing agents, inorganic alkali agents, inorganic antioxidant agents, sequestering agents and antifoggants, wherein said inorganic antioxidant agents comprise $Na_2SO_3$ (sodium sulfite) and $K_2SO_3$ (potassium sulfite) in a molecular ratio of 1:1 to 1:3 in an amount of from 1.6 to 4 moles per liter, the molecular ratio between said inorganic antioxidant agents and the developing agents is from 1.50 to 4.00, and said concentrated developer composition has a specific gravity higher than 1.300 at 20° C.

The developing agents for silver halide photographic materials suitable for the purposes of the present invention are preferably the hydroxybenzene developing agents such as hydroquinone and substituted hydroquinones (e.g. t-butylhydroquinone, methylhydroquinone, dimethylhydroquinone, chlorohydroquinone, dichlorohydroquinone, bromohydroquinone, 1,4-dihydroxynaphthalene, methoxyhydroquinone, ethoxyhydroquinone, etc.). Hydroquinone is preferred. Said silver halide developing agents are generally used in an amount from about 40 to 120 grams per liter, preferably 60 to 100 grams per liter of the concentrated developer composition.

Said developing agents can be used alone or in combination with auxiliary developing agents which show a superadditive effect, such as p-aminophenol and substituted p-aminophenols (e.g. N-methyl-p-aminophenol or metol and 2,4-diaminophenol) and pyrazolidones (e.g. 1-phenyl-3-pyrazolidone or phenidone) and substituted pyrazolidones (e.g. 4-methyl-1-phenyl-3-pyrazolidone and 4,4'-dimethyl-1-phenyl-3-pyrazolidone). Phenidone is preferred. These auxiliary developing agents can be generally used in an amount from about 0.5 to 20, preferably 0.5 to 5 grams per liter of concentrated developer composition.

Inorganic alkali agents used in the concentrated developer composition of the present invention to achieve the preferred pH range, which is above 11, include KOH, NaOH, $K_2CO_3$, $Na_2CO_3$, etc. The preferred alkali agent is KOH.

The sequestering agents used in the formulation of the concentrated developer composition of the present invention are preferably selected from the group of diethylenediaminepentacetic acid (DTPA), 1,3-diamino-2-propanol-tetracetic acid (DPTA), 1-hydroxyethylidene-1,1'-diphosphonic acid (HEDP) and morpholino-methane diphosphonic acid (MMDP). They can be used in an amount of 10 to 100, preferably 10 to 50 grams per liter.

The antifoggant agents, known in the art to eliminate fog on the developed photographic silver halide materials, useful in the concentrated developer composition of this invention include derivatives of benzimidazole, benzotriazole, tetrazole, indazole, thiazole, etc. Preferably, particular mixtures of these antifogging agents are useful to assure low fog levels; such preferred mixtures include mixtures of 5-nitroindazole and benzimidazole nitrate, 5-nitrobenzotriazole and 1-phenyl-1-H-tetrazole-5-thiol and benzotriazole and 1-phenyl-1-H-tetrazole-5-thiol. The most preferred combination is benzotriazole and 1-phenyl-1-H-tetrazole-5-thiol. These mixtures can be used in a total amount of from about 0.1 to 6, preferably 0.2 to 3 grams per liter of the concentrated developer composition. Of course, optimum quantities of each compound and proportion can be found by the skilled in the art to respond to specific needs. In particular, benzotriazole or 5-nitrobenzotriazole have been found to give the best results when used in mixture with 1-phenyl-1-H-tetrazole-5-thiol, the latter being present in minor amount with respect to the total amount, in percent of less than 20%, preferably less than 10%.

Preferably the concentrated developer composition above comprises an organic solvent for the developing agents. Organic solvents for the developing agents useful in the formulation of the concentrated developer composition of this invention can be selected in the class of alkanolamines. Preferred alkanolamines include 2-benzylaminoethanol, ethanolamine, diethanolamine, triethanolamine, choline chloridrate, 3-amino-1-propanol, 1-amino-2-propanol, 2-amino-2-methyl-1,3-propanediol, tris(hydroxymethyl)-aminopropane, 2-methylamino-ethanol, 2-dimethylamino-ethanol, 2-ethylamino-ethanol, 3-dimethylamino-1-propanol and 2-isopropylamino-ethanol. Most preferred alkanolamines include the ethanolamines such as ethanolamine, diethanolamine, triethanolamine, methylaminoethanol, ethylaminoethanol, isopropylaminoethanol and benzylaminoethanol. Other organic solvents can be selected in the class of diarylmethanol compounds. Preferred diarylmethanol compounds include diphenylmethanol, 4,4'-dimethoxydiphenylmethanol, 4,4'-dimethyldiphenylmethanol, 2,2'-dibromodiphenylmethanol, 4,4'-dibromodiphenylmethanol, 2,2'-dinitrodiphenylmethanol, 4,4'-dinitrodiphenylmethanol, 2,3'-dimethoxydiphenylmethanol, 2,4'-dihydroxydiphenylmethanol, 4-methyldiphenylmethanol, 4-ethyldiphenylmethanol. Preferred organic solvents are the alkanolamines which additionally act in the photographic developer compositions as alkali providing compounds, as sequestering agents and as buffers. Said organic solvents for the developing agents can be used in an amount from about 10 to 100, preferably 20 to 50 grams per liter of concentrated developer composition.

Still preferably, the concentrated developer composition above comprises an antifreezing agent. Antifreezing agents used in the present invention include alkylene glycol compounds, e.g. ethylene glycol, 1,2-propylene glycol,, 1,3-propylene glycol, etc. Ethylene glycol is preferred. Said antifreezing agents can be used in an amount of 2 to 30 preferably 5 to 20 grams per liter.

In particular the present invention relates to a concentrated alkaline photographic developer composition, packaged in a single part to be diluted with water to form a ready to use developing solution for silver halide photographic materials, comprising a dihydroxybenzene developing agent in an amount of from 40 to 120 grams per liter, antifogging agents in an amount of from 0.1 to 6 grams per liter, inorganic alkali agents sufficient to provide a pH up to 11, sequestering agents in an amount of from 10 to 50 grams per liter, an organic solvent selected in the class of alkanolamines and diarylmethanol compounds in an amount of from 20 to 50 grams per liter, an antifreezing agent selected in the class of alkylene glycol compounds in an amount of from 5 to 20 grams per liter, and water sufficient to make up 1 liter, characterized in that it comprises inorganic antioxidant agents comprising $Na_2SO_3$ (sodium sulfite) and $K_2SO_3$ (potassium sulfite) in a molecular ratio of 1:1 to 1:3 in an amount of from 1.6 to 4 moles per liter, the molecular ratio between said inorganic dihydroxybenzene developing agents and said inorganic antioxidant agents is from 1.50 and 4.00 and it has a specific gravity at 20° C. higher than 1.300.

Other adjuvants well known in the art can be used in the concentrated developer composition of this invention, these including restrainers, such as soluble halides (e.g. KBr and NaBr), inorganic buffers (e.g. borates, phosphates and carbonates), organic buffers (e.g. glycine and lactic acid), development accelerators, and the like.

The present invention will be better described and illustrated-by the following examples of its practice.

EXAMPLE 1

Nine aqueous alkaline solutions were prepared at room temperature making the additions according to the following Table 1:

TABLE 1

| | $H_2O$ g | KOH 35% (w/w) g | Sp. gravity at 20° C. | $K_2S_2O_5$ moles | $Na_2S_2O_5$ moles | KOH 35% (w/w) g |
|---|---|---|---|---|---|---|
| 1 | 400 | 440 | 1.175 | 0.675 | / | / |
| 2 | 400 | 440 | 1.175 | 0.899 | / | / |
| 3 | 400 | 440 | 1.175 | 1.125 | / | / |
| 4 | 400 | 440 | 1.175 | / | 0.675 | / |
| 5 | 400 | 440 | 1.175 | / | 0.899 | / |
| 6 | 400 | 440 | 1.175 | / | 1.125 | / |
| 7 | 400 | 210 | 1.105 | / | 0.675 | 230 |
| 8 | 400 | 210 | 1.105 | / | 0.899 | 230 |
| 9 | 400 | 210 | 1.105 | / | 1.125 | 230 |

In the following Table 2 are reports the results obtained with the nine solutions above with regards to the solubility of the metabisulfite salt ($Alk_2S_2O_5$) and the crystallization at low temperatures:

TABLE 2

| | Is $Alk_2S_2O_5$ completely dissolved? | If not, why? | Crystallization phenomena after storage at −18° C. |
|---|---|---|---|
| 1 | Yes | / | Absent |
| 2 | Yes | / | Absent |
| 3 | Yes | / | Absent |
| 4 | Yes | / | Present |
| 5 | No | * | / |
| 6 | No | * | / |
| 7 | Yes | / | Present |
| 8 | Yes | / | Present |
| 9 | Yes | / | Present |

*presence of insoluble salts comprising $NaKSO_3$.

By comparing these results, it is evident that, in order to dissolve the sodium metabisulfite in a highly concentrated alkaline solution it is necessary to add the KOH in two times.

EXAMPLE 2

Four concentrated developer compositions were prepared making the additions following the Table 3:

TABLE 3

| Composition | | 1 | 2 | 3 | 4 |
|---|---|---|---|---|---|
| $H_2O$ | g | 445 | 445 | 445 | 445 |
| KOH 35% (w/w) | g | 200 | 200 | 200 | 200 |
| (Specif. gravity at 20° C.) | | | (1,098 ± 0,005) | | |
| Diethanolamine | g | — | 20 | 40 | 40 |
| Ethylene glycole | g | — | — | — | 10 |
| DTPA.5Na 40% (w/w) | g | 19 | 19 | 19 | 19 |
| (Specific. gravity at 20° C.) | | | (1,105 ± 0,005) | | |
| $K_2S_2O_5$ 96% (w/w) [*] | g | 102,4 | 102,4 | 102,4 | 102,4 |
| $Na_2S_2O_5$ 96% (w/w) [**] | g | 90,2 | 90,2 | 90,2 | 90,2 |
| KOH 35% (w/w) | g | 225 | 225 | 225 | 225 |

TABLE 3-continued

| Composition | | 1 | 2 | 3 | 4 |
|---|---|---|---|---|---|
| KBr | g | 16,5 | 16,5 | 16,5 | 16,5 |
| $KHCO_3$ | g | 50 | 50 | 50 | 50 |
| Benzotriazole | g | 1,75 | 1,75 | 1,75 | 1,75 |
| 1-phenyl-1-H-tetrazol-5-tiole | g | 0,15 | 0,15 | 0,15 | 0,15 |
| 1-phenyl-3-pirazolydone | g | 1,9 | 1,9 | 1,9 | 1,9 |
| (Specif. gravity at 20° C.) | | | (≧1,300) | | |
| Hydroquinone | g | 75 | 75 | 75 | 75 |
| $H_2O$ to make | cc | 1000 | 1000 | 1000 | 1000 |
| (% of hydroquinone dissolved at 30° C.) | | ≦5% | ≦80% | 100% | 100% |
| (pH at 20° C.) | | ≧11,00 | ≧11,15 | ≧11,18 | |
| (Specif. gravity at 20° C.) | | ≧1,300 | ≧1,300 | 1,306 | 1,307 |
| Crystallization phenomena (after storage at −18° C.) | | — | — | absent | absent |

[*] $K_2S_2O_5$, if dissolved, gives 2 moles of $K_2SO_3$ per mole of $K_2S_2O_5$
[**] $Na_2S_2O_5$, if dissolved, gives 1 mole of $Na_2SO_3$ and mole of $K_2SO_3$ per mole of $Na_2S_2O_5$.

By comparing these results with those of example 1, it is evident that, in order to avoid the crystallization phenomena at −18° C., it is necessary to use in the concentrated developer composition both $Na_2S_2O_5$ and $K_2S_2O_5$ and that the content of an inorganic solvent as diethanolamine assures the dissolution of the whole quantity of the developing agent.

EXAMPLE 3

200 Ml of the concentrated developer composition 4 of example 2 was diluted with water to form 1 liter of a ready to use developer solution and then 100 ml of this solution were put into an open 1 liter flask and stored at room temperature for three days in contact with air.

The same experiment was repeated with a commercial concentrated developer composition A having the following formulation:

| Composition A | | |
|---|---|---|
| $H_2O$ | g | 450 |
| KOH 35% (w/w) | g | 370 |
| $K_2S_2O_5$ | g | 175 |
| Diethanolamine | g | 78 |
| Lactic acid | g | 40 |
| DTPA.5Na 40% (w/w) | g | 25 |
| Benzotriazole | g | 3.25 |
| 1-phenyl-5-mercaptotetrazole | g | 0.14 |
| KBr | g | 16.5 |
| $K_2CO_3$ | g | 49 |
| 1-phenyl-3-pyrazolidone | g | 1.2 |
| Hydroquinone | g | 80 |
| $H_2O$ to make | ml | 1000 |
| (pH at 20° C.) | | 11.15 |
| (specific gravity at 20° C.) | | 1.295 |

The following Table 4 reports the results of the stability to the aerial oxidation of the two ready for use developing solutions (solution 1 deriving from concentrated developer composition 4 of the example 1 and solution 2 deriving from concentrated developer composition A). The results relate to the increase of pH (the aerial oxidation of alkaline developers containing hydroquinone causes an increase of pH), the darkening of the solutions, the increase of dissolved oxygen and the worsening of the sensitometric characteristics (decrease of Dmax) of a photographic material developed therein. Dmax test was made by exposing and then processing for 45" at 35° C. strips of 3M RAN Graphic Art Film in fresh and oxidized developing solutions.

TABLE 4

| | Solutions | | | |
|---|---|---|---|---|
| | 1 | | 2 | |
| | fresh | oxidized | fresh | oxidized |
| pH | 10,55 | 11,85 | 10,45 | ≧12,00 |
| color | pale-yellow | yellow | pale-yellow | dark brown |
| oxygen | / | +0,15% | / | +1.80% |
| Dmax | 4,90 | 4,60 | 4,60 | 2,0 |

I claim:

1. A concentrated alkaline photographic developer composition, packaged in a single part to be diluted with water to form a ready to use developing solution for silver halide photographic materials, which composition comprises dihydroxybenzene developing agents, inorganic alkali agents, inorganic antioxidant agents, sequestering agents and antifoggants, wherein said inorganic antioxidant agents comprise $Na_2SO_3$ (sodium sulfite) and $K_2SO_3$ (potassium sulfite) in a molecular ratio of 1:1 to 1:3 in an amount of from 1.6 to 4 moles per liter, the molecular ratio between said inorganic antioxidant agents and the developing agents is from 1.5 to 4.00, and said concentrated developer composition has a specific gravity higher than 1.300 at 20° C.

2. A concentrated photographic developer composition according to claim 1 comprising an organic solvent for the developing agents selected in the class of alkanolamines and diarylmethanol compounds.

3. A concentrated photographic developer composition according to claim 1 comprising an antifreezing agent selected in the class of alkylene glycol compounds.

4. A concentrated photographic developer composition according to claim 1 wherein said dihydroxybenzene developing agent is hydroquinone.

5. A concentrated photographic developer composition according to claim 2 wherein said organic solvent for the developing agents is diethanolamine.

6. A concentrated photographic developer composition according to claim 3 wherein said antifreezing agent is ethylene glycol.

7. A concentrated developer composition, packaged in a single part to be diluted with water to form a ready to use developing solution for silver halide photographic materials, comprising a dihydroxybenzene developing agent in an amount of from 40 to 120 grams per liter, antifogging agents in an amount of from 0.1 to 6 grams per liter, inorganic alkali agents sufficient to provide a pH up to 11, sequestering agents in an amount of from 10 to 50 grams per liter, an organic solvent selected in the class of alkanolamines and diarylmethanol compounds in an amount of from 20 to 50 grams per liter, an antifreezing agent selected in the class of alkylene glycol compounds in an amount of from 5 to 20 grams per liter, and water sufficient to make up 1 liter, characterized in that it comprises inorganic antioxidant agents comprising $Na_2SO_3$ (sodium sulfite) and $K_2SO_3$ (potassium sulfite) in a molecular ratio of 1:1 to 1:3 in an amount of from 1.6 to 4 moles per liter, the molecular ratio between said inorganic dihydroxybenzene developing agents and said inorganic antioxidant agents is from 1.50 to 4.00 and it has a specific gravity at 20° C. higher than 1.300.

8. A method of making a concentrated alkaline photographic developer composition, packaged in a single part to be diluted with water to form a ready to use developing solution for silver halide photographic materials, which comprises dihydroxybenzene developing agents, inorganic alkali agents, inorganic antioxidant agents, sequestering agents and antifoggants, characterized in that comprises the following steps:

(a) preparing an aqueous KOH concentrated solution having a specific gravity not higher than 1.110 at 20° C., (b) adding to the resulting solution inorganic antioxidant agents wnich form sulfite anions ($SO_3^{--}$) in aqueous solution, at least half in moles of which being $Na_2S_2O_5$ (sodium metabisulfite), in a quantity of from 0.8 to 2 moles per liter, (c) adding to the resulting solution further aqueous KOH concentrated solution until the specific gravity of the resulting solution is ≧1.175 at 20° C., (d) adding to the resulting solution developing agents in such a quantity that the molecular ratio between said inorganic antioxidant agents and the developing agents is from 1.5 to 4.00, and (e) adding the other components of the developer composition in such a quantity to obtain a concentrated developer composition having a specific gravity higher than 1.300 at 20° C.

9. A method for making a concentrated alkaline developer composition according to claim 8, wherein said inorganic antioxidant agents which form sulfite anions ($SO_3^{--}$)in aqueous solutions comprise $Na_2S_2O_5$ (sodium metabisulfite) and $K_2S_2O_5$ (potassium metabisulfite) in a molecular ratio of 1:1.

* * * * *